US011370650B2

(12) United States Patent
Currie

(10) Patent No.: US 11,370,650 B2
(45) Date of Patent: Jun. 28, 2022

(54) PEDAL-OPERATED DEVICE FOR HANDS FREE OPERATION OF A BEVERAGE DISPENSER

(71) Applicant: Michael Lee Currie, Winnipeg (CA)

(72) Inventor: Michael Lee Currie, Winnipeg (CA)

( * ) Notice: Subject to any disclaimer, the term of this patent is extended or adjusted under 35 U.S.C. 154(b) by 0 days.

(21) Appl. No.: 17/411,623

(22) Filed: Aug. 25, 2021

(65) Prior Publication Data

US 2022/0063983 A1 Mar. 3, 2022

Related U.S. Application Data

(60) Provisional application No. 63/070,499, filed on Aug. 26, 2020.

(51) Int. Cl.
*B67D 3/00* (2006.01)
*B67D 3/04* (2006.01)

(52) U.S. Cl.
CPC ..... *B67D 3/0058* (2013.01); *B67D 3/04* (2013.01)

(58) Field of Classification Search
CPC ..... B67D 3/04; B67D 3/0058
See application file for complete search history.

(56) References Cited

U.S. PATENT DOCUMENTS 6,041,977 A * 3/2000 Lisi ..... A21C 15/005 222/575
6,047,863 A * 4/2000 Kanzler ..... B65D 88/68 222/413
6,325,250 B1 * 12/2001 Feola ..... A23G 9/228 222/399
7,278,553 B2 * 10/2007 Py ..... B67D 1/0004 222/207
8,201,588 B2 * 6/2012 Bonner ..... B67D 7/048 141/59
9,157,549 B2 * 10/2015 Ashby ..... F16K 31/62
2005/0279763 A1 * 12/2005 Adell ..... A61C 17/065 222/137

* cited by examiner

*Primary Examiner* — Frederick C Nicolas
(74) *Attorney, Agent, or Firm* — Kyle R Satterthwaite; Ryan W DuPuis; Ade & Company Inc.

(57) ABSTRACT

A pedal-operated device for hands-free operation of a beverage dispenser features a support structure mounted or mountable to a perimeter wall structure of the beverage dispenser, and a working unit movably supported on said support structure and configured for movement between a working position forcing a spigot actuator of the dispenser into an open position, and a default rest position releasing the spigot actuator back into a closed position. An included foot pedal has a foot pad movable between a default upper position and a depressed lower position. A cable is connected between the foot pad and said working unit to pull said working unit into the working position under depression of the foot pad.

11 Claims, 4 Drawing Sheets

PEDAL-OPERATED DEVICE FOR HANDS FREE OPERATION OF A BEVERAGE DISPENSER

FIELD OF THE INVENTION

The present invention relates generally to beverage dispensers, and more particularly to hands-free dispensing of beverages therefrom.

BACKGROUND

The current COVID-19 pandemic has raised the standard for sanitary handling of food and beverage, and of equipment related to the preparation, dispensing and distribution of same, in response to which Applicant has developed a novel solution for hands-free dispensing of beverages from conventionally hand-operated beverage dispensers, the details of which are disclosed herein as follows.

SUMMARY OF THE INVENTION

According to one aspect of the invention, there is provided a pedal-operated device for hands-free operation of a beverage dispenser that comprises an internal reservoir for holding a consumable liquid, a perimeter wall structure standing upright from a floor of said internal reservoir in surrounding relation thereto to hold the consumable liquid therein, and a dispensing spigot penetrating said perimeter wall structure into the internal reservoir and comprising a spigot actuator situated outside said perimeter wall structure and movable between a closed position to an open position to dispense said consumable liquid from the internal reservoir, said pedal-operated device comprising:

a support structure mounted or mountable to the perimeter wall structure of the beverage dispenser;

a working unit movably supported on said support structure and configured for movement between a working position forcing said spigot actuator into the open position, and a default rest position releasing said spigot actuator back into the closed position;

a foot pedal comprising a base and a foot pad movably supported on said base for movement between a default upper position and a depressed lower position; and a cable connected between said foot pad and said working unit to pull said working unit into the working position under depression of said foot pad.

BRIEF DESCRIPTION OF THE DRAWINGS

One embodiment of the invention will now be described in conjunction with the accompanying drawings in which.

DETAILED DESCRIPTION

Figure 1:
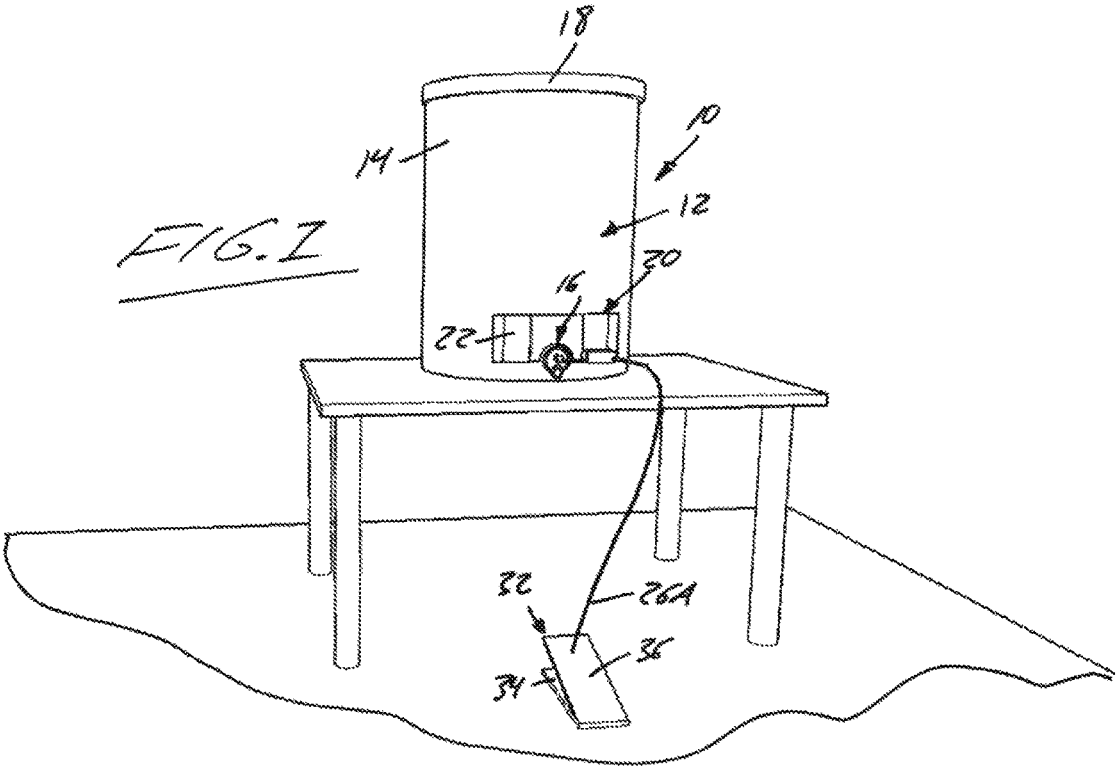
FIG. 1 is a perspective view of a first embodiment of a foot-operated device for hands free dispensing of a beverage, shown in use on a normally hand-operated beverage dispenser of a type having a cylindrical shape and push-button spigot.
Figure 2:
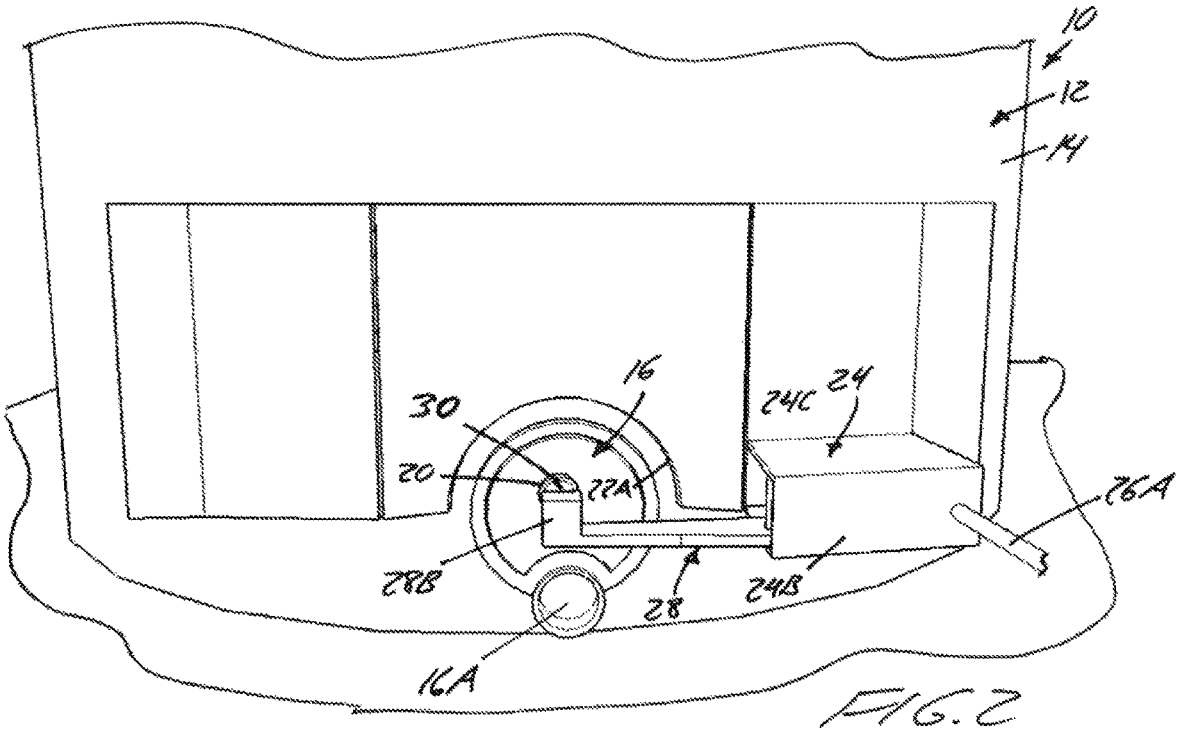
FIG. 2 is a closeup partial front view of the device of FIG. 1.
Figure 3:
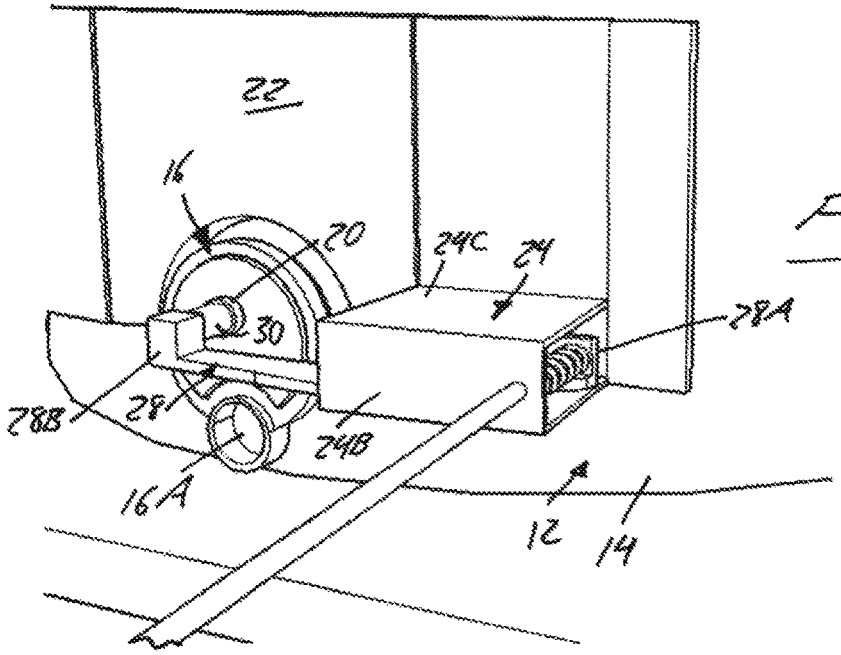
FIG. 3 is a closeup partial perspective view of the device of FIG. 1.
Figure 4:
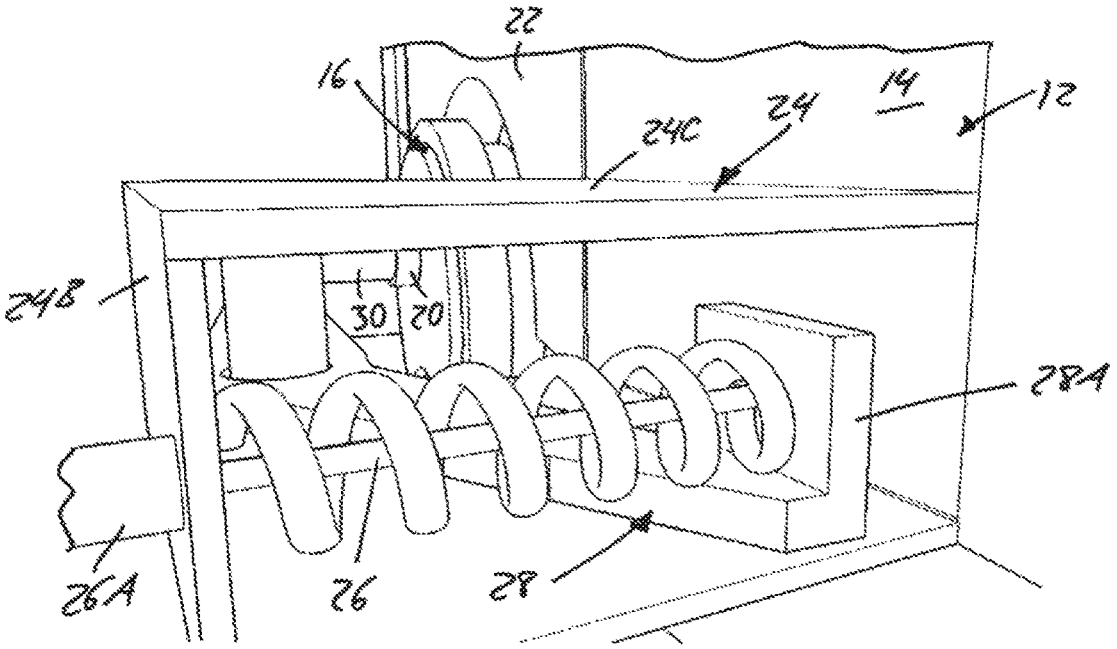
FIG. 4 is a further closeup perspective view of the device of FIG. 3.

FIGS. 1 through 4 illustrated a first embodiment of a pedal-operated device for hands-free operation of a beverage dispenser. In the first embodiment, the beverage dispenser 10 is a generally cylindrical water cooler composed of a cylindrical container 12 having a generally circular bottom wall whose topside defines the floor of an internal reservoir whose perimeter is delimited by a generally cylindrical perimeter wall 14 that stands upright from the perimeter of the bottom wall in order to contain a consumable liquid within the generally cylindrical volume of the internal reservoir. A push-button dispensing spigot 16 penetrates the cylindrical perimeter wall 14 at a relatively low elevation thereon near the reservoir floor for the purpose of dispensing the consumable liquid from the internal reservoir of the container. A generally circular lid 18 is installed atop the perimeter wall 14 to normally cap off the internal reservoir during use of the beverage dispenser, but is removable for the purpose of filling the reservoir, and for cleanout between uses. The dispensing spigot 16 has a push button actuator 20 that, when depressed into an open position, opens up the spigot to dispense the consumable beverage from the outlet 16A thereof.

The device 20 of the first embodiment features a mounting plate 22 attachable to the cylindrical perimeter wall 14 of the container 12 at a location near the spigot 16, for example using use of threaded fasteners (not shown) piercing the exterior of the normally insulated perimeter wall of the container, but preferably not piercing the interior of the perimeter wall so as to maintain the water-tight integrity thereof at the reservoir perimeter. Alternatively, if the interior of the perimeter wall is pierced, sufficient water-tightness may still be maintained by use of a gasket or seal between the mounting plate and perimeter wall exterior at any fastener-penetrated area of the wall. Alternatively, it may be possible to adhesively bond, plastic weld or otherwise attach the mounting plate to the perimeter wall without use of surface penetrating fasteners. In the illustrated example, the mounting plate has an arcuate cutout 22A in a bottom edge thereof so as to be placeable in a position saddling the spigot 16 in non-interfering and non-obstructing relation thereto.

On one side of the spigot 16, a support housing 24 cantilevers outward from the mounting plate 22 at an elevation overlapping with that of the push-button actuator 20 of the spigot 16, thus residing externally in front of the perimeter wall 14 of the dispenser container 12 at a position closely beside the spigot. Inside the housing, a cylindrical boss or shaft 26 stands upright from a base 24A of the housing 24, and has a pivotable working lever 28 journaled thereon for horizontally pivotal movement of this working lever about an upright pivot axis defined by the boss or shaft 26. A front wall 24B of the housing 24 situated oppositely of the perimeter wall 14 of the dispenser container 12 stands upright from the base 24A of the housing 24 to connect same to an opposing top wall 24C of the housing 24. The front housing wall 24B is penetrated by a control cable 26 whose output end is attached to the working lever 28 near an input end 28A thereof that is situated furthest from the spigot 16. An opposing output end 28B of the working lever 28 resides in front of the push-button actuator 20 of the spigot in spaced relation therefrom, and features an actuator engagement boss 30 projecting inwardly toward the push-button actuator 20. In a default resting position of the working lever 28, the actuator engagement boss 30 is either in contactless but closely adjacent relationship to the push-button actuator 20 of the spigot 16, or in slight non-forceful contact therewith exerting little or no force thereon, i.e. insufficient force to actually depress the push-button actuator 20 from its default position closing the spigot.

The device 20 also includes a foot pedal 32 having a stationary base 34 for placement on the floor or ground, and a movable foot pad 36 hinged to the base for upward and downward pivotal movement relative thereto between a default upper position (shown) and a depressed lower position (not shown). An input end of the control cable 26 is attached to the foot pad 36 of the pedal 32, whereby depression of the foot pad 36 by a user's foot will pull on the output end of the control cable 26 that's connected to the input end 28A of the working lever 28. The control cable in the illustrated embodiment is the inner cable of a Bowden cable, whose outer sheath 26A runs from the foot pad 36 of the pedal to the support housing in which the working lever is pivotally carried.

Pulling of the input end 28A of the working lever 28 by the control cable 26 when the foot pad 36 of the pedal 32 is depressed pivots the output end 28B of the working lever 28 toward the container 12, thus driving the actuator engagement boss 30 into forceful contact against the push-button actuator 20 of the spigot 16, thereby depressing the push-button actuator 20 and dispensing the consumable liquid from the internal reservoir of the container 12 through the spigot 16. Once the desired amount of liquid has been dispensed, lifting of the user's foot from the pedal 32 relieves the pulling force on the input end 28A of the working lever 28, thus relieving the working end's pushing force against the push-button actuator 20. Though the push-button actuator is configured to automatically self-return to a closed position stopping flow through the spigot, the illustrated embodiment also features a resilient compression spring 36 coiled around the portion of the control cable 26 inside the housing 24 between the housing's front wall 24B and the working lever 28 in order to spring bias the working lever 28 out of its working position forcefully contacting the push-button actuator, and back into its default resting position, just in case the self returning action of the push-button actuator 20 is insufficient to reset the working lever to its default resting position.

Figure 5:
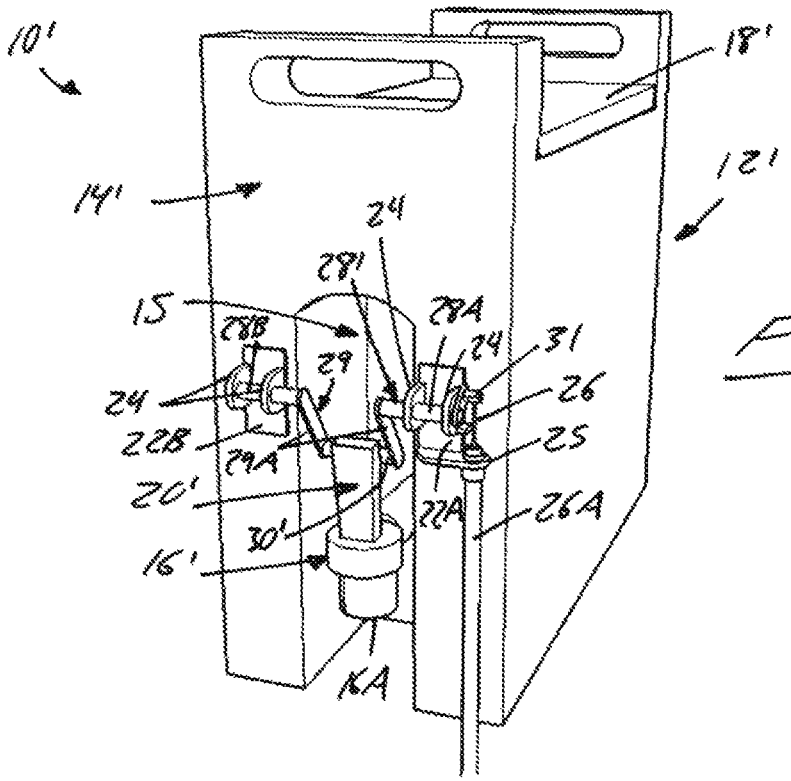
FIG. 5 is a perspective view of a second embodiment of a foot-operated device for hands free dispensing of a beverage, shown in use on a normally hand-operated beverage dispenser of a type having a more rectangular shape and a tilt-lever spigot.
Figure 6:
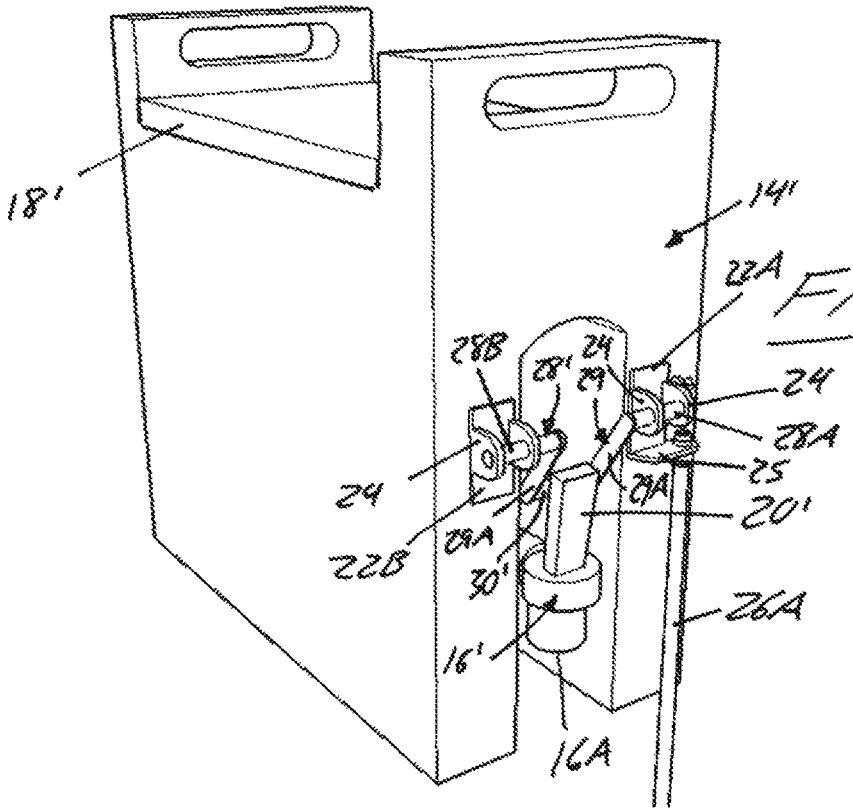
FIG. 6 is another perspective view of the device of FIG. 5.
Figure 7:
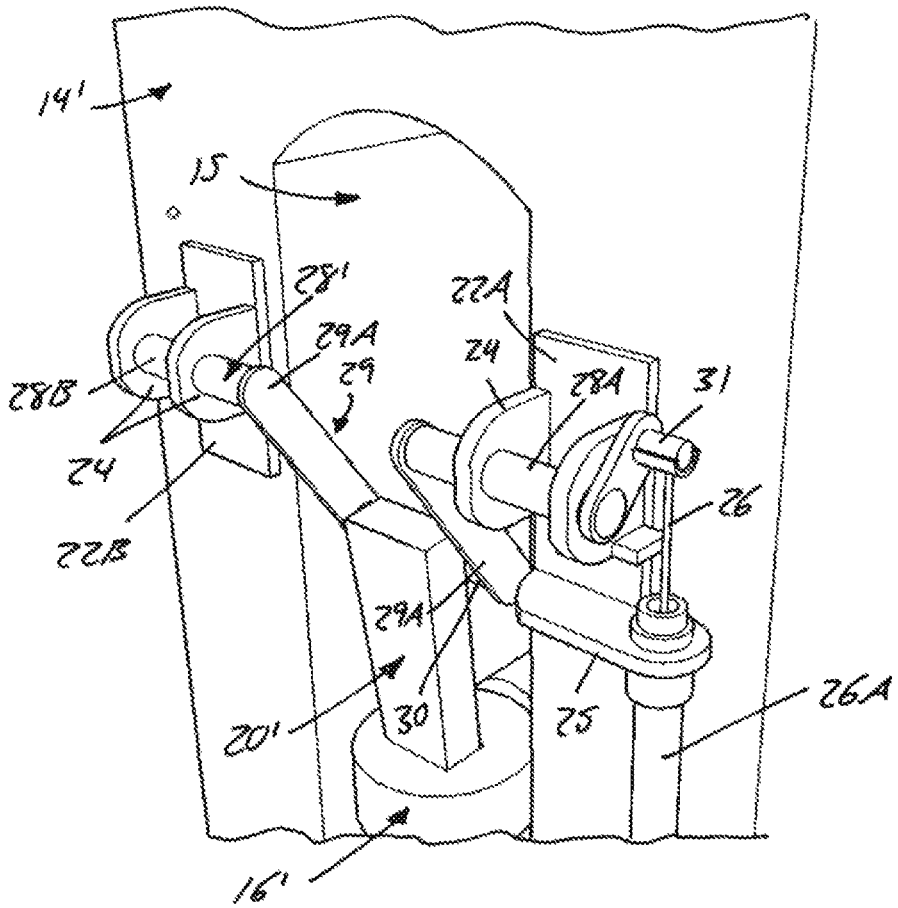
FIG. 7 is a closeup partial perspective view of the device of FIG. 5.

FIGS. 5 through 7 illustrated a second embodiment in which the foot operated device is modified for use on a different style of beverage dispenser 10', which has a more rectangularly shaped container 12' whose perimeter wall structure is composed of discrete front, side and rear walls rather than the cylindrical wall of the earlier embodiment. In the illustrated example, the front perimeter wall 14' of the container 12 is mostly planar, but has a recessed cavity 15 situated midway across the front perimeter wall 14' and spanning upward from a matching void in the container's bottom wall. A closed top end of the cavity 15 resides at an intermediate elevation above the spigot 16', but stopping short of the removable top lid 18' of the container, which is typically held place atop the perimeter walls by releasable latches (not shown). The spigot resides inside this cavity 15 in recessed relation to the planar remainder of the front perimeter wall 14'. Instead of a push-button spigot, the dispenser features a tilt-lever spigot 16' having an upright actuating lever 20' that must be tilted forwardly, conventionally in manually actuated fashion, to open the spigot and dispense the consumable liquid through the outlet 16A thereof. This style of beverage dispenser is often used for coffee, hot water for tea, or other hot beverages, whereas the earlier water-cooler style dispenser is typically used for cold water or other cold beverages.

Instead of a singular mounting plate like the first embodiment, the illustrated example of the second embodiment uses two smaller mounting plates 22A, 22B mounted to the planar outer regions of the front perimeter wall 14' on either side of the central cavity 15, though a larger singular plate saddling the top end of the cavity could be used. Instead of a singular support housing pivotally supporting a horizontally pivotable working lever, this embodiment uses a pair of support lugs 24 jutting out from each mounting plate 22A, 22B to support two ends 28A, 28B of a working shaft 28' in a manner rotatable about a horizontal rotation axis thereof. The two lug-supported ends 28A, 28B of the working shaft 28' are coincident with the shaft's rotation axis, but a central area of the working shaft features an eccentric output crank 29. The output crank 29 features two identical crank arms 29A jutting radially from the rotation axis by equal distance and shared direction to one another into the cavity 15 of the container's front perimeter wall 14', and an actuator engagement rod 30 that joins together the two crank arms in parallel relation to the rotation axis at an eccentrically radial distance therefrom behind the actuating lever 20' of the spigot 16'. In a default resting position of the working shaft 28', the actuator engagement rod 30 is either in contactless relationship to the actuating lever 20' of the spigot 16', or in only slight contact therewith exerting little or no force thereon, i.e. insufficient force to actually tilt the actuating lever 20' forwardly into its open position.

At one of its supported ends 28A, the working shaft 28' features an eccentric input crank 31 to which the output end of the control cable 26 is attached at a radial distance outward from the horizontal rotational axis of the working shaft 28'. The mounting plate 22A whose support lugs 24 carry this end of the working shaft 28' also features a cable support flange 25 to which the outer sheath 26A of the Bowden control cable 26 is attached, and through which the inner cable passes upwardly to connect to the input crank 31. Depression of the foot pad 36 of the pedal 32 is thereby operable to pull down on this input crank 31, thereby rotating the working shaft 28' into a working position forcing the actuator engagement rod 30 'forwardly against the actuating lever 20' of the spigot 16', thereby opening of the spigot and dispending the consumable liquid therefrom, until the user's foot pressure is released form the foot pad 36 of the pedal 32. Through not shown, a return spring may again be used to automatically bias the device into the default resting position, for example in this case using a compression spring (not shown) optionally coiled around the control cable 26 at the area between the cable support flange 25 and the input crank 31 in order to push the input crank 31 upwardly away from the cable support flange 25, thus encouraging the crank-carried actuator engagement rod 30 rearwardly and upwardly out of its working position.

Though in the illustrated embodiment, the mounting plates 22A, 22B are mounted above the spigot, with the output crank reaching downwardly behind the spigot's actuating lever 20', the working shaft could be mounted lower down, with an eccentric crank reaching upwardly around the actuator lever 20' from below, provided that the input crank position is adjusted accordingly so as to swing the crank in the appropriate direction to push forwardly on the backside of the actuating lever 20' when the foot pad 36 of the pedal 32 is depressed. In another variant of the second embodiment, instead of a crank 29 having two crank arms 29A reaching behind the actuating lever 20' of the spigot 16' on either side thereof to appropriate position an actuator engagement rod 30 behind the actuating lever, another embodiment may employ an actuator engagement cap that is shaped to fit over a top end of the actuating lever 20' to cause the forward tilting thereof under pulling of the input crank 31.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A pedal-operated device for hands-free operation of a beverage dispenser that comprises an internal reservoir for holding a consumable liquid, a perimeter wall structure standing upright from a floor of said internal reservoir in surrounding relation thereto to hold the consumable liquid therein, and a dispensing spigot penetrating said perimeter wall structure into the internal reservoir and comprising a spigot actuator situated outside said perimeter wall structure and movable between a closed position to an open position to dispense said consumable liquid from the internal reservoir, said pedal-operated device comprising:

a support structure mounted or mountable to the perimeter wall structure of the beverage dispenser;

a working unit movably supported on said support structure and configured for movement between a working position forcing said spigot actuator into the open position, and a default rest position releasing said spigot actuator back into the closed position;

a foot pedal comprising a base and a foot pad movably supported on said base for movement between a default upper position and a depressed lower position; and a cable connected between said foot pad and said working unit to pull said working unit into the working position under depression of said foot pad.

2. The device of claim 1 wherein the working unit comprises a working lever pivotable by the cable about a pivot axis between the working position and the default rest position.

3. The device of claim 2 wherein the pivot axis has an upright orientation about which an actuator engaging portion of the working unit is arranged to pivot toward the perimeter wall of the beverage dispenser under depression of the foot pad.

4. The device of claim 2 wherein the support structure comprises a support housing in which the working lever is pivotally mounted.

5. The device of claim 1 in combination with the beverage dispenser, wherein said spigot actuator is a push button actuator that is depressed by the working position of the working unit.

6. The device of claim 1 wherein the working unit comprises a working shaft rotatable about a rotation axis, and an actuator engaging portion that is connected to said shaft and resides eccentrically thereof for engagement with the spigot actuator to drive movement thereof under rotation of said shaft.

7. The device of claim 6 wherein the working shaft comprises an output crank having crank arms arranged to reach rearwardly past the spigot actuator on opposing sides thereof to carry the actuator engaging portion therebehind.

8. The device of claim 6 wherein the support structure comprises a set of support lugs mounted to the perimeter wall structure on opposing sides of the spigot to rotatably carry opposing ends of the working shaft.

9. The device of claim 6 wherein the working shaft comprises an eccentric input crank to which the output end of the control cable is coupled.

10. The device of claim 1 in combination with the beverage dispenser, wherein said spigot actuator is a lever actuator that is tilted out the closed position by the working position of the working unit.

11. The device of claim 1 wherein the working unit is spring biased into the default rest position.

* * * * *